US008449338B2

(12) United States Patent
Gong et al.

(10) Patent No.: US 8,449,338 B2
(45) Date of Patent: May 28, 2013

(54) ELECTRICAL CONNECTOR

(75) Inventors: Jinlong Gong, Shanghai (CN); Manqian Wang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 13/332,586

(22) Filed: Dec. 21, 2011

(65) Prior Publication Data

US 2012/0171889 A1 Jul. 5, 2012

(30) Foreign Application Priority Data

Dec. 30, 2010 (CN) ..... 2010 2 0697481 U

(51) Int. Cl.
*H01R 13/15* (2006.01)

(52) U.S. Cl.
USPC ..... 439/839; 439/682

(58) Field of Classification Search
USPC ..... 439/682, 856, 857, 862, 861, 839
See application file for complete search history.

(56) References Cited

U.S. PATENT DOCUMENTS

| | | | | |
|---|---|---|---|---|
| 4,351,583 | A * | 9/1982 | Belttary | 439/839 |
| 4,932,877 | A * | 6/1990 | Zinn | 439/839 |
| 5,679,034 | A * | 10/1997 | Hanazaki et al. | 439/845 |
| 6,568,955 | B2 * | 5/2003 | Hotea et al. | 439/495 |
| 7,595,715 | B2 * | 9/2009 | Pavlovic et al. | 337/198 |
| 7,802,994 | B1 * | 9/2010 | Chen et al. | 439/65 |
| 7,892,050 | B2 * | 2/2011 | Pavlovic et al. | 439/839 |
| 8,182,299 | B2 * | 5/2012 | Schrader | 439/857 |

* cited by examiner

*Primary Examiner* — Tho D Ta
*Assistant Examiner* — Travis Chambers
(74) *Attorney, Agent, or Firm* — Barley Snyder

(57) ABSTRACT

An electrical connector has at least two contact assemblies spaced apart from each other by a first distance to receive corresponding one of at least two plug conductors being spaced apart from each other by a second distance. Each of the at least two contact assemblies includes a pair of contact members for contacting one corresponding plug conductor, and a clamping member configured to clamp the pair of contact members to apply a holding force onto the pair of contact members and the corresponding plug conductor. The clamping member is inserted through the pair of contact members in a direction opposite to a mating direction, and the clamping member and the pair of contact members are adapted to swing in a direction substantially perpendicular to the mating direction in order to compensate for a difference between the first and second distances.

14 Claims, 4 Drawing Sheets

ELECTRICAL CONNECTOR

CROSS-REFERENCE TO RELATED APPLICATION

This application claims the benefit and priority of Chinese Patent Application No. 201020697481.3 filed on Dec. 30, 2010 before the State Intellectual Property Office of China, the disclosure of which is incorporated herein by reference.

FIELD OF INVENTION

The invention relates to an electrical connector, and more particularly, to an electrical connector capable of achieving a good contact with plug conductors having a large position error therebetween.

BACKGROUND

Electrical connectors are generally used in power distribution systems to distribute electric power from a power source to a plurality of electric equipment or make electrical connections between the electric equipment. In such power distribution systems or electric equipment, the electrical connector connects two or more plug conductors to achieve power transmission.

In general, as shown in FIG. 1A, plug conductors 20 are spaced apart from each other by a predetermined distance which is designed to be the same as that between contact terminals 11 of an electrical connector 10, thereby achieving a correct connection between the plug conductors 20 and the contact terminals 11. However, there is usually a difference between an actual spaced distance between two plug conductors and a standard distance for them due to production tolerance. Furthermore, it is hard to avoid mounting position error when mounting the electrical connector, as indicated by "A" shown in FIG. 1B. When the above difference and/or position error is large, the plug conductors could not be inserted smoothly into the electrical connector, or not properly contact thereby resulting in a poor electrical contact.

Furthermore, conventional electrical connectors only permit a very small error for the above distances, such as 0.1 mm to 0.15 mm, which requires great precision for production and mounting of electrical connectors and plug conductors. Thus, It would be desirable to provide an improved electrical connector, of which contact assemblies are designed to be floated, i.e. swung or deflected within an angle range, such that the electrical connector could permit a greater position error for inserting the plug conductors and achieve an unhindered inserting and a good contact.

SUMMARY

The invention has been made in view of at least one aspect of the above mentioned disadvantages.

According to an embodiment of the invention, there is provided with an electrical connector, having at least two contact assemblies spaced apart from each other by a first distance to receive a corresponding one of at least two plug conductors being spaced apart from each other by a second distance. Each of the at least two contact assemblies includes: a pair of contact members for contacting one corresponding plug conductor; and a clamping member configured to clamp the pair of contact members to apply a holding force onto the pair of contact members and the corresponding plug conductor; wherein, the clamping member is inserted through the pair of contact members in a direction opposite to a mating direction. The clamping member and the pair of contact members are adapted to swing in a direction substantially perpendicular to the mating direction in order to compensate for a difference between the first and second distances.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF EMBODIMENTS

Figure 1A:
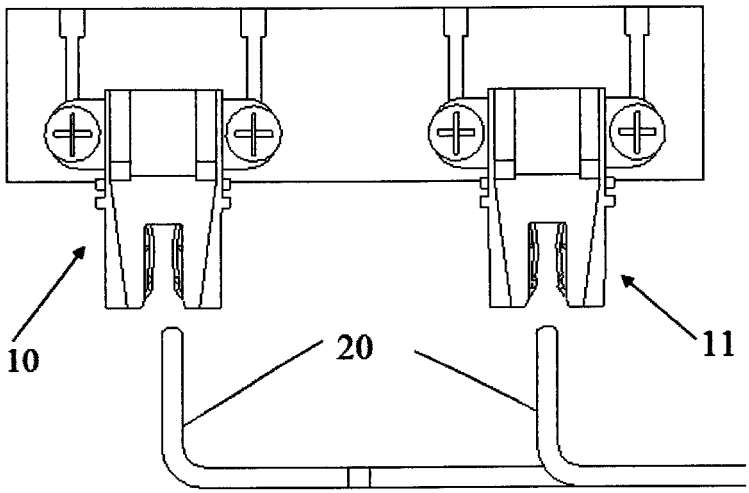
FIG. 1A is a plan view illustrating plug conductors inserted into an electrical connector.

Embodiments of the invention will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the disclosure will be thorough and complete, and will fully convey the concept of the invention to those skilled in the art.

Figure 1B:
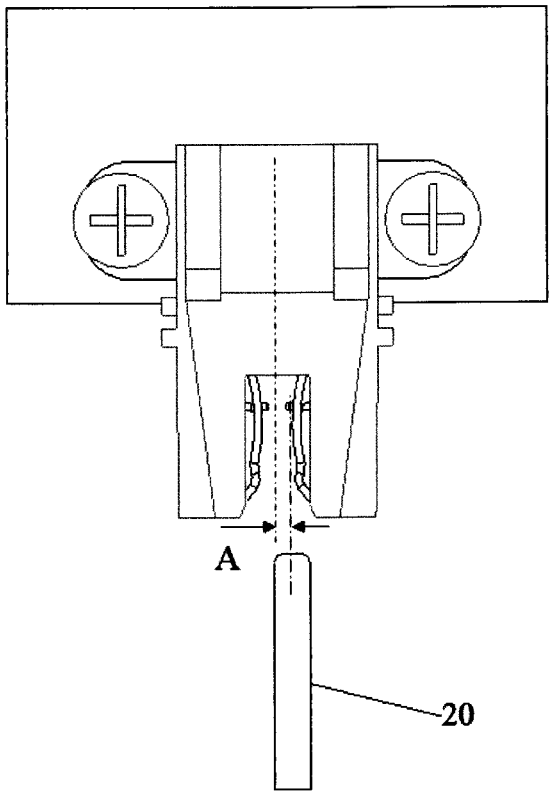
FIG. 1B is a plan view illustrating a position difference "A" between the plug conductors to be inserted and an electrical connector in prior art.
Figure 2A:
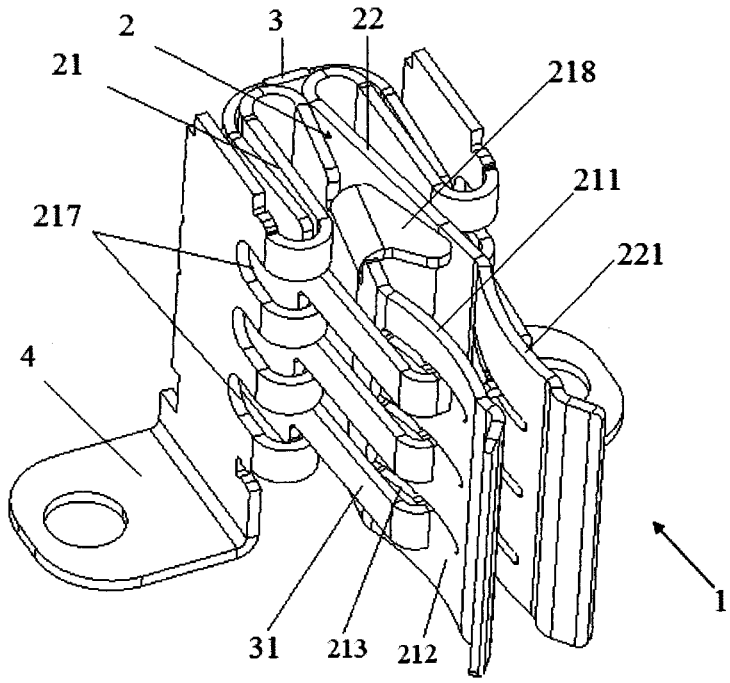
FIG. 2A is a perspective view illustrating a contact assembly of an electrical connector according to an embodiment of the invention.
Figure 2B:
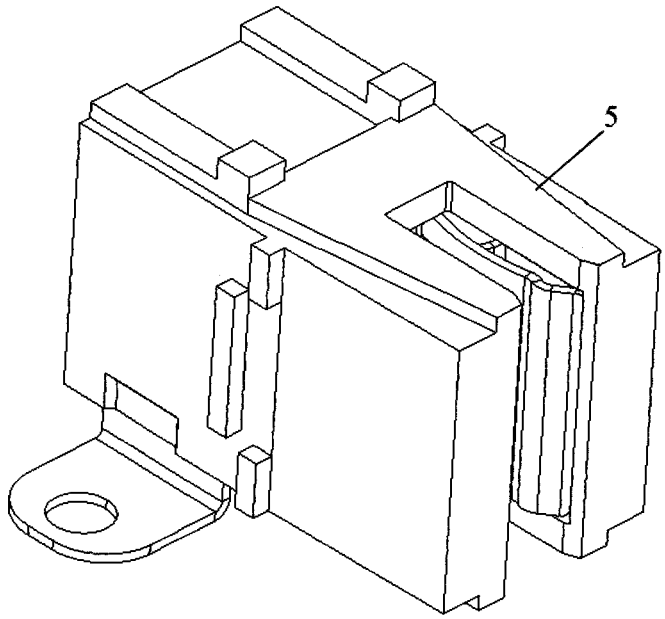
FIG. 2B is a perspective view illustrating the contact assembly of the electrical connector according to an embodiment of the invention.

FIG. 2A illustrates a contact assembly, before packaging, of an electrical connector according to an embodiment of the invention, and FIG. 2B illustrates the contact assembly packaged with a housing 5. An electrical connector generally comprises at least two contact assemblies for receiving at least two plug conductors, such as two contact assemblies as shown in FIG. 1.

As shown in FIG. 2A, according to an embodiment of the invention, each of contact assemblies 1 of an electrical connector includes a pair of contact members 2 and a clamping member 3, the pair of contact members 2 includes a right contact member 21 and a left contact member 22. Each contact member 2 is provided with a contact terminal 211 or 221 adapted to contact the plug conductors inserted therein, thereby achieving power transmission or electrical connections. The clamping member 3 is configured to clamp the pair of contact members 2 and one corresponding plug conductor inserted therein in order to obtain a good electrical contact. In one embodiment of the invention, the clamping member 3 is inserted through the pair of contact members 2 to clamp the contact terminals 211 and 221 thereof, such that the contact terminals firmly contact with the plug conductors inserted therein.

Figure 3A:
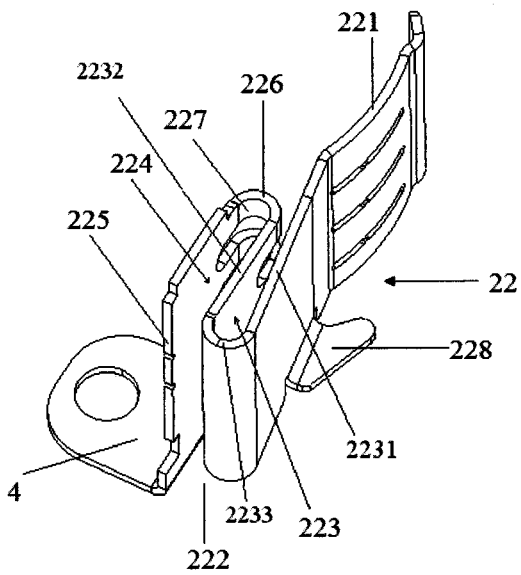
FIGS. 3A and 3B are perspective views illustrating structures of left and right contact terminals of one contact assembly according to an embodiment of the invention.
Figure 3B:
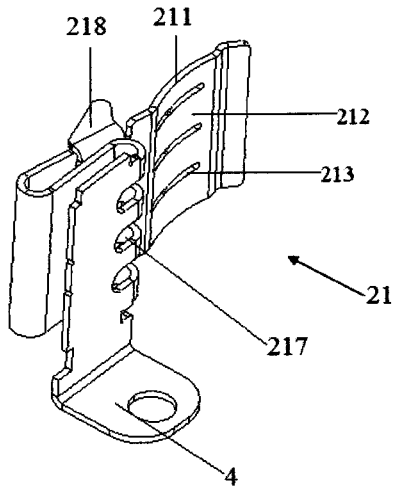

FIGS. 3A and 3B illustrate the right contact member 21 and the left contact member 22 in detail. As shown, the right contact member 21 and the left contact member 22 are constructed to be symmetrical, and thus only the left contact member 22 will be described in detail with reference to FIG. 3A.

According to an embodiment of the invention, the left contact member 22 includes a contact terminal 221 and an elastic S-shaped mechanism 222, which may be integrally formed or be connected together. The contact terminal 221 is made of metal materials, and has a contact surface adapted to contact the inserted plug conductor. As shown, the contact surface of the contact terminal 221 may have an arc shape protruding toward a corresponding contact terminal of the right contact member, but is not limited to this. According to one example, the elastic S-shaped mechanism 222 is made of elastic materials, and when the contact terminal 221 is deflected or swung due to insertion of the plug conductors, at least a part of the elastic S-shaped mechanism 222 will be elastically deformed to apply a force against deflection or swing of the contact terminal 221.

As shown in FIG. 3A, the elastic S-shaped mechanism 222 includes a first U-shaped portion 223 and a second U-shaped portion 224 which are connected together, with openings thereof being opposed to each other, to form an S-shape. The first U-shaped portion 223 is connected with the contact terminal 221, and the second U-shaped portion 224 is adapted to connect with a fastener 4 for mounting or securing the electrical connector onto a substrate such as a circuit board. In one example, the first U-shaped portion 223 and the second U-shaped portion 224 have heights or widths in a direction perpendicular to the substrate and lengths extending substantially in a mating direction.

In one embodiment of the invention, as shown in FIG. 3A, the first U-shaped portion 223 includes a first arm 2231 connected with the contact terminal 221, a common arm 2232, and a first bottom portion 2233 located between and connected with the first arm and the common arm. The second U-shaped portion 224 includes a second arm 225 connected with the fastener 4, the common arm 2232, and a second bottom portion 226 located between and connected with the second arm 225 and the common arm 2232. Therefore, the first U-shaped portion 223 and the second U-shaped portion 224 are integrated by the common arm to form the elastic S-shaped mechanism 222. At least one slot 227 is formed in the second bottom portion 226 and extends respectively by a certain length towards the common arm and the second arm. In the present invention, the right contact member 21 is symmetrical with the left contact member 22 and also formed with at least one similar slot 217, as shown in FIG. 3B.

Figure 4:
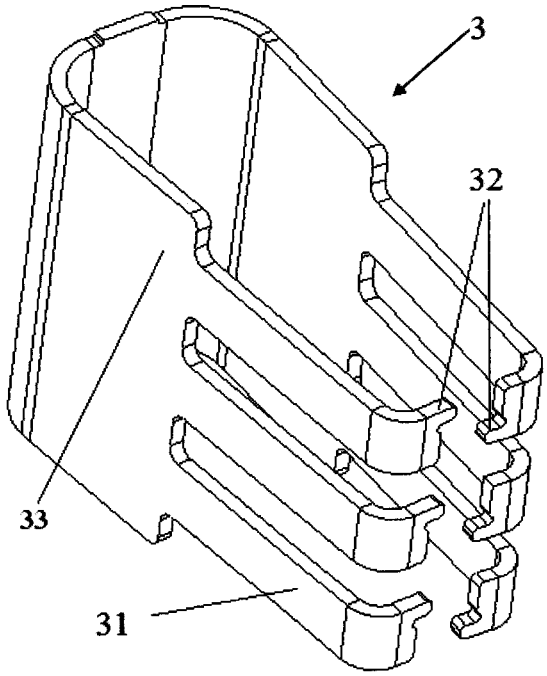
FIG. 4 is perspective view illustrating a clamping member of one contact assembly according to an embodiment of the invention.

In one example of the invention, as shown in FIGS. 2A and 4, the clamping member 3 comprises a U-shaped clamping member comprising two third arms 33, each of two free ends of the two third arms is respectively provided with at least one finger-like clamping body 31. The at least one finger-like clamping body 31 is inserted through the corresponding slots 227 or 217. Each of the finger-like clamping body 31, when inserting through the slots 227 and 217, is configured to tightly contact the contact terminals 221 and 211 of the contact member to apply a holding force for firmly hold the inserted plug conductors.

As shown in FIG. 2A and FIGS. 3A and 3B, each contact terminal includes a clamping surface, e.g. the clamping surface 212 of the contact terminal 211, for contacting with the finger-like clamping body 31, and the clamping surface is opposite to the above contact surface. According to one embodiment of the present invention, a plurality of grooves, e.g. the grooves 213 in the clamping surface 212, are provided in the clamping surface, and a free end of each finger-like clamping body 31 is provided with a protrusion 32 extending substantially perpendicularly to the clamping surface, as shown in FIGS. 2A and 4. The protrusion 32 is adapted to be embedded into one corresponding groove, and configured to slide in the one corresponding groove when the contact terminal 221 or 211 swings or deflects in the right and left direction, such that the clamping member 3 will tightly clamp the contact members 2 while swinging or deflecting with the contact members 2.

According to the invention, the finger-like clamping bodies 31 of the clamping member 3 could be inserted through the slots 227 and 217, and are allowed to swing or deflect in a right and left direction within the slots consistent with the mating direction when the clamping member 3 is subjected to an external force, such as a deflecting force applied when non-centrosymmetric insertion of the plug conductors into the electrical connector is performed.

In one example of the invention, the clamping member 3 is a U-shaped member, the finger-like clamping bodies 31 of which are inserted through the slots 217 and 227 of the contact members 2 in the direction opposite to the mating direction. The U-shaped member therefore surrounds the first U-shaped portion 223 of the S-shaped mechanism and, and the second arms 225 of the second U-shaped portion 224 which is connected with the fastener 4 is arranged outside of the U-shaped member. Opening width of the second U-shaped portion 224 or spacing distance between the common end 2233 and the second arms 225 could be designed as required to accommodate the deflection of the clamping member 3.

According to one example, as shown in FIGS. 2A and 3A-3B, each of the pair of contact members 2 may be provided with at least one spacing member, such as a spacing member 218 on the right contact member 21 or a spacing member 228 on the left contact member 22. The spacing member is configured to maintain a gap in which one plug conductor is to be inserted between the contact terminals.

Figure 5A:
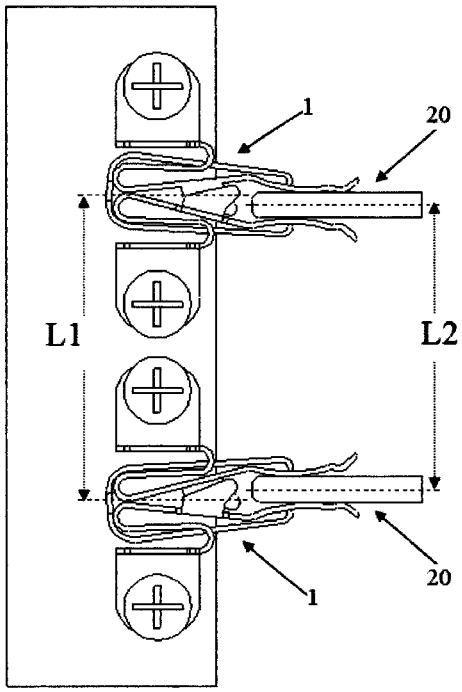
FIGS. 5A and 5B are plan views illustrating the plug conductors inserted into the electrical connector according to the invention with different distance differences between them.
Figure 5B:
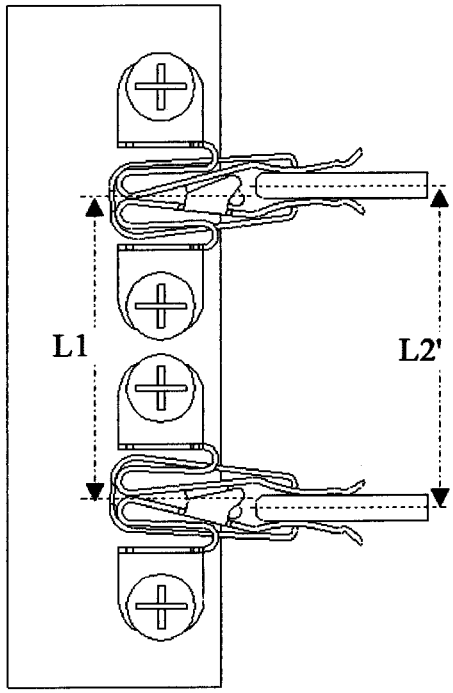

FIGS. 5A and 5B illustrate the plug conductors inserted into the electrical connector according to the invention under different distance differences between them. In FIGS. 5A and 5B, the electrical connector has two contact assemblies for receiving two plug conductors, however, the invention is not limited to this, and the number of the contact assemblies may be three or more.

As shown in FIG. 5A, a spacing distance between the two contact assemblies 1 is represented by L1, and another spacing distance between the two plug conductors is represented by L2 which is smaller than L1. In this case, under the influence of an external force, such as an external force applied when inserting the plug conductors 20 and a force applied by rigidly fixed plug conductors onto the contact assemblies after the inserting, the contact assemblies will be deflected or swung. Specifically, two sets of contact terminals of the two contact assemblies are deflected inwardly to be closed with each other until the spacing distance between the two sets of contact terminals, that is, the spacing distance between centerlines thereof, becomes equal to the spacing distance L2 between the two plug conductors, thereby making sure an unhindered inserting of the plug conductors. More specifically, in the case shown in FIG. 5A, an inside S-shaped mechanism of each contact member is elastically deformed and shrunk (or compressed), and an outside S-shaped mechanisms of the same contact member is elastically deformed and expanded, thus causing the pair of contact terminals of the same contact member to swing or deflect simultaneously toward inside and firmly contact and retain corresponding one inserted plug conductor. Moreover, the clamping member will be deflected together with the contact members, for example, the finger-like clamping bodies 31 formed on the two arms of the clamping member will slide in the two slots 227 and 217, respectively, in order to follow the deflection of the contact member while clamping the contact member, thus, enabling not only an unhindered inserting of the plug conductors into the electrical connectors in a case in which there is a large difference in spacing distance between the plug conductors and the electrical connectors, but also provision of a sufficient holding force for the plug conductors, and thereby achieving a good electrical contact.

Similarly, as shown in FIG. 5B, a spacing distance between the two contact assemblies is represented by L1, and another spacing distance between the two plug conductors is represented by L2' which is larger than L1. In this case, under influence of an external force, the contact assemblies will be deflected or swung. Specifically, the two sets of contact terminals of the two contact assemblies are deflected outwardly to be apart from each other until the spacing distance between the two sets of contact terminals becomes equal to the spacing distance L2' between the two plug conductors, thereby ensuring an unhindered insertion of the plug conductors. More specifically, in the case shown in FIG. 5B, the inside S-shaped mechanism is elastically deformed and expanded, and an outside S-shaped mechanism is elastically deformed, thus causing the pair of contact terminals of the left contact member to swing or deflect simultaneously toward outside and to firmly contact and retain corresponding inserted plug conductor. Moreover, the clamping member mounted on the left contact member will be deflected together with the left contact member. For example, the finger-like clamping bodies 31 formed on the two arms of the clamping member slide in the slots 227 and 217, respectively, in order to follow the deflection of the contact member while clamping the contact member, thus, enabling not only an unhindered inserting of the plug conductors into the electrical connectors in a case in which there is a large difference in spacing distance between the plug conductors and the electrical connectors, but also giving a sufficient holding force for the plug conductors, and thereby achieving a good electrical contact.

As discussed above, according to the invention, the contact assemblies of the electrical connector are designed to be floated, such that an inserting angle for the plug conductors could be adjusted according to differences in position and distances between the contact assemblies and the plug conductors, thereby achieving an unhindered inserting of the plug conductors. Moreover, since portions for holding the contact terminals are configured as an S-shaped mechanism, a larger angle adjustment could be obtained due to a greater elastic deformation of the S-shaped mechanism. And further, the clamping member is inserted through slots formed in the S-shaped mechanism and thus a greater degree of deflection or swinging could be obtained, allowing greater position and distance error. Meanwhile, by means of the elasticity of the S-shaped mechanism and/or the greater degree of deflection or swinging of the clamping member in the slots, a sufficient holding force is be applied by the clamping member when the contact members are deflected or swung to any desired position, thus achieving a good electrical contact and avoiding disengaging of the plug conductors during operating.

Although several embodiments have been shown and described, it would be appreciated by those skilled in the art that various changes or modifications may be made in these embodiments without departing from the principles and spirit of the disclosure, the scope of which is defined in the appended claims and their equivalents.

In the above described electrical connector, each of the pair of contact members may be provided with at least one spacing member configured to maintain a gap in which one plug conductor is to be inserted between the contact terminals.

In the above described electrical connector, the elastic S-shaped mechanism may include a first U-shaped portion connected with one corresponding contact terminal and a second U-shaped portion through which the clamping member is inserted, the first U-shaped portion and the second U-shaped portion being integrated to form an S-shape.

In the above described electrical connector, the second U-shaped portion may include: a first arm integrated with one arm of the first U-shaped portion; a second arm connected with a fastener for mounting the electrical connector onto a circuit board; and a bottom portion provided between the first arm and the second arm, and formed with at least one slot through which the clamping member is inserted.

In the above described electrical connector, the clamping member may be constructed as a U-shaped member comprising two arms and inserted through the pair of contact members in the direction opposite to the plugging-in direction of the plug conductors, such that the first U-shaped portion is arranged inside of the U-shaped member and the second arm of the second U-shaped portion is arranged outside of the U-shaped member.

In the above described electrical connector, the clamping member may include at least one finger-like clamping body being adapted to insert through the elastic S-shaped mechanism and configured to tightly contact the contact members to apply the holding force.

In the above described electrical connector, the clamping member may include at least one finger-like clamping body formed on each of two free ends of the two arms, and adapted to insert through the at least one slots and configured to tightly contact the contact members to apply the holding force.

In the above described electrical connector, each contact member may include a clamping surface in which a plurality of grooves are provided, each finger-like clamping body is provided with a protrusion extending substantially perpendicularly to the clamping surface, and the protrusion is embedded into one corresponding groove and adapted to slide in the one corresponding groove when the pair of contact members swing.

In the above described electrical connector of the present invention, the contact assemblies thereof could be designed to be swung or deflected within an angle range, such that an inserting angle for the plug conductors could be adjusted according to differences in position and distances between the contact assemblies and the plug conductors, thereby achieving an unhindered inserting of the plug conductors. Moreover, since portions for holding the contact terminals is configured as an S-shaped mechanism, a larger angle adjustment could be obtained due to a greater elastic deformation of the S-shaped mechanism. And further, the clamping member is inserted through openings formed in the S-shaped mechanism and thus could make a greater degree of deflection or swinging, allowing greater position and distance error. Meanwhile, by means of the elasticity of the S-shaped mechanism and/or the greater degree of deflection or swinging of the clamping member in the openings, a sufficient holding force could be applied by the clamping member, thus achieving a good electrical contact and avoiding disengaging of the plug conductors during operating.

What is claimed is:

1. An electrical connector, comprising:

at least two contact assemblies spaced apart from each other by a first distance to receive a corresponding one of at least two plug conductors being spaced apart from each other by a second distance;

each of the at least two contact assemblies including:

a pair of contact members each for contacting one corresponding plug conductor; and a clamping member configured to clamp the pair of contact members;

the clamping member being inserted through the pair of contact members in a direction opposite to a mating direction, and the clamping member and the pair of contact members being adapted to swing in a direction substantially perpendicular to the mating direction in order to compensate for a difference between the first and second distances.

2. The electrical connector according to claim 1, wherein each of the pair of contact members includes a contact terminal having a contact surface adapted to contact the plug conductors.

3. The electrical connector according to claim 2, wherein each of the pair of contact members includes an elastic S-shaped mechanism connected with the contact terminal, the clamping member being inserted through the elastic S-shaped mechanism.

4. The electrical connector according to claim 3, wherein each of the pair of contact members is provided with at least one spacing member configured to maintain a gap in which one plug conductor is to be inserted between the contact terminals.

5. The electrical connector according to claim 3, wherein the clamping member includes at least one finger-like clamping body being adapted to insert through the elastic S-shaped mechanism and configured to contact the contact members.

6. The electrical connector according to claim 3, wherein the elastic S-shaped mechanism includes a first U-shaped portion connected with one corresponding contact terminal and a second U-shaped portion through which the clamping member is inserted, the first U-shaped portion and the second U-shaped portion being integrated to form an S-shape.

7. The electrical connector according to claim 6, wherein the second U-shaped portion includes a first arm integrated with one arm of the first U-shaped portion.

8. The electrical connector according to claim 7, wherein the second U-shaped portion includes a second arm connected with a fastener for mounting the electrical connector onto a circuit board.

9. The electrical connector according to claim 8, wherein the second U-shaped portion includes a bottom portion provided between the first arm and the second arm, and formed with at least one slot through which the clamping member is inserted.

10. The electrical connector according to claim 9, wherein the clamping member is constructed as a U-shaped member comprising two arms and inserted through the pair of contact members in the direction opposite to the mating direction, such that the first U-shaped portion is arranged inside of the U-shaped member and the second arm of the second U-shaped portion is arranged outside of the U-shaped member.

11. The electrical connector according to claim 10, wherein the clamping member includes at least one finger-like clamping body formed on each of two free ends of the two arms, and adapted to insert through the at least one slots and configured to contact the contact members.

12. The electrical connector according to claim 11, wherein each contact member includes a clamping surface in which a plurality of grooves is provided.

13. The electrical connector according to claim 12, wherein each finger-like clamping body is provided with a protrusion extending substantially perpendicularly to the clamping surface.

14. The electrical connector according to claim 13, wherein the protrusion is embedded into one corresponding groove and adapted to slide in the one corresponding groove when the pair of contact members swing.

* * * * *